United States Patent [19]

Nishiyama

[11] Patent Number: 4,540,269

[45] Date of Patent: Sep. 10, 1985

[54] OPENING DETECTING DEVICE OF A COPY DOCUMENT COVER SUITABLE FOR ELECTROPHOTOGRAPHIC COPYING MACHINE

[75] Inventor: Haruo Nishiyama, Nara, Japan

[73] Assignee: Sharp Kabushiki Kaisha, Osaka, Japan

[21] Appl. No.: 545,543

[22] Filed: Oct. 26, 1983

[30] Foreign Application Priority Data

Oct. 28, 1982 [JP] Japan ..... 57-164245[U]

[51] Int. Cl.[3] ..... G03G 15/00

[52] U.S. Cl. ..... 355/3 R; 355/75; 340/686; 340/689; 340/545

[58] Field of Search ..... 355/75, 3 R, 133; 340/686, 689, 568, 545, 600; 250/229, 230

[56] References Cited

U.S. PATENT DOCUMENTS 3,697,762 10/1972 Kurtz ..... 250/229
4,074,246 2/1978 Conklin et al. ..... 340/545
4,391,505 7/1983 Silverberg ..... 355/3 R

FOREIGN PATENT DOCUMENTS 54-46259 9/1979 Japan ..... 355/3 R
56-97530 5/1981 Japan ..... 355/75

*Primary Examiner*—R. L. Moses
*Assistant Examiner*—D. S. Warren
*Attorney, Agent, or Firm*—Birch, Stewart, Kolasch & Birch

[57] ABSTRACT

An electrophotographic copying machine having a device for detecting the opening and the closing of a document cover on a document table. The device contains a light emitting element, a light receiving element, a reflective sheet and a detection circuit. The reflective sheet reflects light from the light emitting element toward the light receiving element. The light receiving element is responsive to the reflected light for providing a detection signal. The detection circuit receives the detection signal to detect the opening and the closing of the document cover.

13 Claims, 7 Drawing Figures

OPENING DETECTING DEVICE OF A COPY DOCUMENT COVER SUITABLE FOR ELECTROPHOTOGRAPHIC COPYING MACHINE

BACKGROUND OF THE INVENTION

The present invention relates to an electrophotographic copying machine and, more particularly, to a device for detecting the opening of a document cover above a document table for an electrophotographic copying machine.

An electrophotographic copying machine produces an electrostatic latent image on an optical-sensitive member. The latent image corresponds to an image on a copy document such as a manuscript or book to be copied. Toner particles are electrically adhered to the latent image, so that the latent image becomes visible to form a toner image. The toner image is transferred onto a copy paper via a transference charger.

Conventionally, the copy document is disposed on a document table on which a document cover is provided for being able to cover the copy document when the copy document is subject to optical scanning. The document cover is pivotally secured to make the copy document opened and closed. The document cover serves to press the document upon the document table and to seal scanning light beneath the document cover.

Some electrophotographic copying machines provide the scanning light by detecting the closing of the document cover, so as to execute the copying operation.

To detect the closing of the document cover, a lead switch means is conventionally provided whose contacts are closed by pivotally closing the document cover. Unless the document cover is completely closed, the lead switch contacts are not closed. In some instances, the copy document is too thick to permit the document cover to be completely closed. In such a case, as the lead switch contacts are opened, it is detected that the document cover is opened, so that the copying machine may not be operated.

Therefore, it is desired to provide an improved detection device for detecting the opening and the closing of the document cover on the document table.

SUMMARY OF THE INVENTION

Accordingly, it is an object of the present invention to provide an improved device for detecting the opening and the closing of a document cover on a document table.

It is another object of the present invention to provide an improved device for detecting the opening and the closing of a document cover on a document regardless the thickness of a copy document.

Briefly described, in accordance with the present invention, an electrophotographic copying machine comprises a device for detecting the opening and the closing of a document cover upon a document table. The device comprises a light emitting element and a light receiving element, a reflection sheet, and a detection circuit. The reflection sheet is attached to part of the document cover. The reflection sheet reflects light from the light emitting element toward the light receiving element. The light receiving element is responsive to the reflected light for providing a detection signal. The detection circuit receives the detection signal to detect the opening and the closing of the document cover.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

Figure 1:
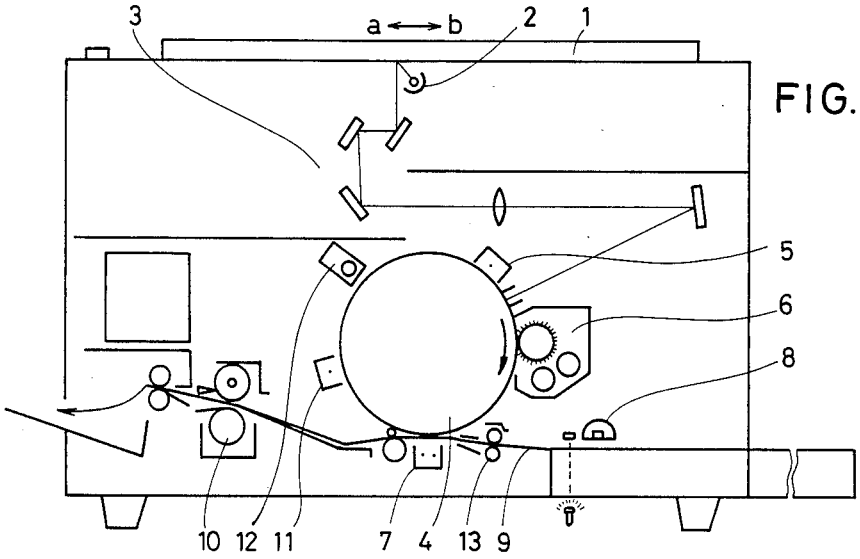
FIG. 1 shows a sectional view of an electrophotographic copying machine according to the present invention.

FIG. 1 shows a sectional view of an electrophotographic copying machine of the present invention. A type of electrophotographic copying machine for reciprocating a document table for carrying a copy document such as a manuscript or book is shown. However, it should be noted that the present invention can be applied to another type of electrophotographic copying machine comprising part of an optical scanning system including lenses and mirrors, the part being moved along the document table.

The electrophotographic copying machine of FIG. 1 comprises a document table 1, a light source 2, an optical system 3, an optical-sensitive member 4, a pre-charger 5, a developing section 6, a transference charger 7, a paper pick-up roller 8 and a pair of paper supply rollers 13 for a paper 9, an image fixing device 10, a charge-removal charger 11, and a cleaner 12.

The document table 1 is positioned at the top of the copying machine. The table 1 can be reciprocated in the directions a and b. On the table 1, a copy document such as a manuscript or book is disposed to which light is projected by the light source 2. The optical system 3 is used to focus a reflected image from the object on the optical-sensitive member 4. The optical system 3 comprises lenses and mirrors for this purpose.

The optical scanning system 3 is fixed while the table 1 is moved. Otherwise, it may be possible that part of the lenses and the mirrors forming the optical scanning system 3 is moved while the table 1 is fixed.

The optical-sensitive member 4 is formed around a drum. The pre-charger 5 is provided for uniformly pre-charging the optical-sensitive member 4 before the member 4 receives the reflected image.

Responsive to the reflected light image from the object, an electrostatic latent image is formed on the optical-sensitive member 4. The developing section 6 is provided for changing the latent image into visible toner image. The transference charger 7 is provided for electrostatically transferring the toner image upon the paper 9 which is picked up by the paper pick-up roller 8. The image fixing device 10 is provided for fixing the toner image on the paper 9, so that the image on the copy object is copied on the paper 9.

After the toner image is transferred on the paper 9, the remaining charges on the optical-sensitive member 4 are removed by the charge-removal charger 11. The cleaner 12 is provided for cleaning the toner particles remaining on the optical-sensitive member 4.

Responsive to a paper pick-up signal generated in response to the generation of a copy start signal, the paper pick-up roller 8 is rotated at a full turn, so that a single sheet of the paper 9 is picked up. The picked-up paper 8 stops at the position of the pair of paper supply rollers 13. This is because the leading edge of the latent image on the optical-sensitive member 4 must correspond to the leading edge of the picked-up paper 9. Responsive to a position detection signal developed by timing when the object plate 1 is on the way in the light exposure direction b, the pair of paper supply rollers 13 are rotated to start the supply of the paper 9.

Figure 2:
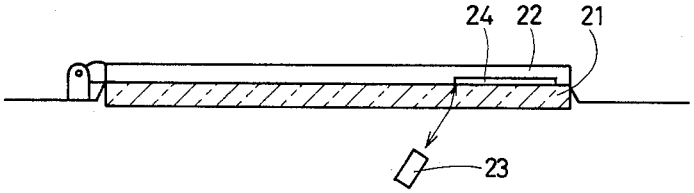
FIGS. 2 and 3 show a sectional view of a device for detecting the opening and the closing of a document cover onto a document table eqipped with a light emitting element and a light receiving element according to a preferred embodiment of the present invention.
Figure 3:
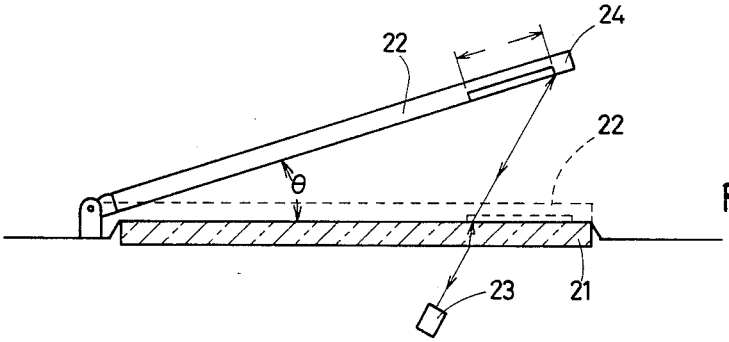

FIGS. 2 and 3 show a sectional view of a device for detecting the opening and the closing of a document cover on the document table 1 according to the present invention.

The device comprises a document table plate 21, a document cover 22, a sensor 23, and a reflection sheet 24. A copy document is disposed onto the document table plate 21 as described above.

The document table plate 21 is composed of a glass plate. The end of document cover 22 is pivotally supported to the body of the copying machine so as to cover and uncover the copy document. The sensor 23 is provided for detecting the opening and the closing of the document cover 22. The reflection sheet 24 is supported on the document cover 22 to reflect light from the sensor 23 toward the sensor 23.

The reflective sheet 24 may be a sheet comprising a great number of glass beads embedded within a plastic base. Such a sheet is sold under the trade name "SCOTCHLITE" by SUMITOMO 3M LTD., Japan.

The sensor 23 is separated from the table plate 21 having the region in which the copy document is to be positioned on the table plate 21 while it is positioned beneath the plate 21. The sensor 23 comprises a light emitting element comprising a strongly directional light emitting diode (LED) and a light receiving element comprising a strongly directional photodiode. The light emitting element directly light toward the reflection sheet 24 which is on the document cover 22 to be closed. It is to be noted that the light emission position by the light emitting element is separated from the optical scanning position for enabling the copying operation. The reflection sheet 24 is made of a material for reflecting the received light in a direction toward in the countering direction, so that the light from the light emitting element is reflected back toward the light receiving element.

The light emitting element is in an inclined position so as to direct the light toward the direction in which the document cover 22 starts to become open. The reflection sheet 24 has a length "l" enough to reflect any light from the light emitting element even when the document cover 22 cannot be completely closed owing to the thick thickness of the copy document and the document cover 22 forms an angle theta against the table plate 21.

If the cover 22 is opened having the angle theta even pressing the copy document, the reflection sheet 24 can reflect the light from the light emitting element toward the light receiving element. Responsive to the receipt of the light, it is detected that the cover 22 covers the document table plate 21. If the cover 22 is opened more than the angle theta, the light from the light emitting element is not able to be incident upon the reflection sheet 24, so that the light receiving element cannot receive the light. It is detected that the cover 22 does not cover the document table plate 21.

Figure 4:
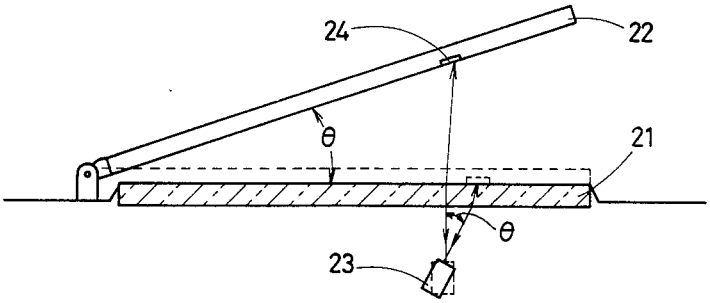
FIG. 4 shows a sectional view of the detection device according to another preferred form of the present invention.

It may be assumed that it is impossible to expand the length of the reflection sheet beyond the length "l" of FIG. 3. FIG. 4 shows another preferred embodiment of the present invention in such a case.

As FIG. 4 shows, the reflection sheet 24 is disposed in the only limited space.

In FIG. 4, the sensor 23 is tilted within the angle theta in accordance with the pivot movement of the cover 22, so as to provide light incident upon the reflection sheet 24 and to receive the reflected light therefrom even when the cover 22 with the reflection sheet 24 is inclined within the angle theta.

With reference to FIG. 4, when the cover 22 completely covers the document table plate 21, the sensor 23 is inclined by the angle theta, so that the light from the sensor 23 is able to be incident upon the reflective sheet to reflect it toward the sensor 23. When the cover 22 is opened within the angle theta, the sensor 23 is rotated within the angle theta, so that the light from the sensor 23 can be incident upon the reflective sheet 24 and reflected by it. It is detected that the cover 22 covers the document table plate 21. When, nevertheless, the sensor 23 cannot receive the light from the reflective sheet 24, it is detected that the cover 22 is opened more than the angle theta with respect to the document table plate 21. When the sensor 23 cannot receive the light from the reflective sheet 24, this indicates that the cover 22 does not cover the copy document on the document table plate 21.

An angle detection means may be provided for detecting the pivotal angle of the cover 22. The output of the angle detection means is applied to the sensor 23 of FIG. 4 to tilt the sensor 23 by the pivotal angle.

Figure 5:
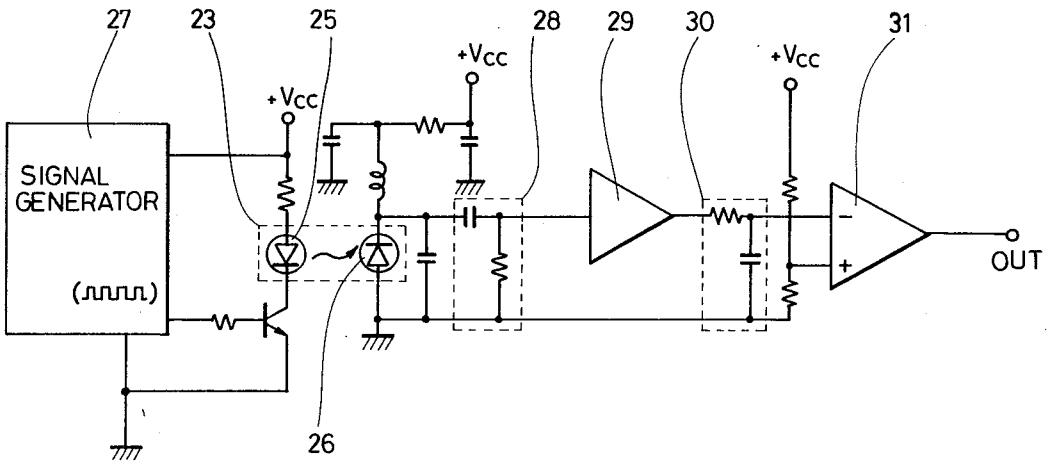
FIG. 5 shows a block diagram of a detection circuit according to the present invention.

FIG. 5 shows a block diagram of a detection circuit according to the present invention. The output of the sensor 23 is applied to the detection circuit of FIG. 5.

The detection circuit comprises the sensor 23 comprising a light emitting element 25 and a light receiving element 26, a signal generator 27, a differential circuit 28, an amplifier 29, an integration circuit 30, and a comparator 31.

The signal generator 27 provides pulses for activating the light emitting element 25. Responsive to the pulses from the generator 27, the light emitting element 25 is modulated to emit the light. The light receiving element 26 receives the light from the element 25, so that the output of the element 26 is applied into the amplifier 29 via the differential circuit 28. The output of the amplifier 29 is entered into the minus input terminal of the comparator 31 via the integration circuit 30. To the minus input terminal, a compared voltage is inputted. A divided voltage from the power voltage +VCC of a power source is entered into the plus input terminal of the comparator 31. To the plus input terminal of the comparator 31, a reference voltage is inputted.

The light from the element 25 is incident upon the reflective sheet 24 when the cover 22 is inclined against the plate 21 within the angle theta. The reflective sheet 24 reflects the light toward the element 26. Responsive to the reflected light from the sheet 24, the element 26 provides an output into the amplifer 29 via the differential circuit 28. The amplifer 29 amplifies the output from the element 26 to output an output. The provide of the amplifier 29 is entered into the comparator 31. When the amplified output of the amplifier 29 is greater than the reference voltage applied to the plus input terminal of the comparator 31, the output of the comparator 31 changes a high level signal "H" to a low level signal "L".

When the cover 22 is opened more than the angle theta, the element 26 cannot receive any light. The reference voltage of the comparator 26 is more than the voltage applied to the minus input terminal. The comparator 31 outputs the high level output "H". The reference voltage of the comparator 31 is set to be greater than the output of the amplifier 29 when the element 26 cannot receive the light from the reflective sheet 24 owing to the condition that the cover 22 is opened more than the angle theta.

The amount of the angle theta can be freely selected. The amount of the angle theta depends upon the thickness of the copy document.

Since the reflective sheet 24 is disposed on the cover 22, accurate detection of the opening and the closing of the cover 22 can be expected regardless the shape of the cover 22.

Responsive to the outputs of the comparator 31, a control circuit of the electrophotographic copying machine provides a control signal necessary for operating the copying machine.

Figure 6:
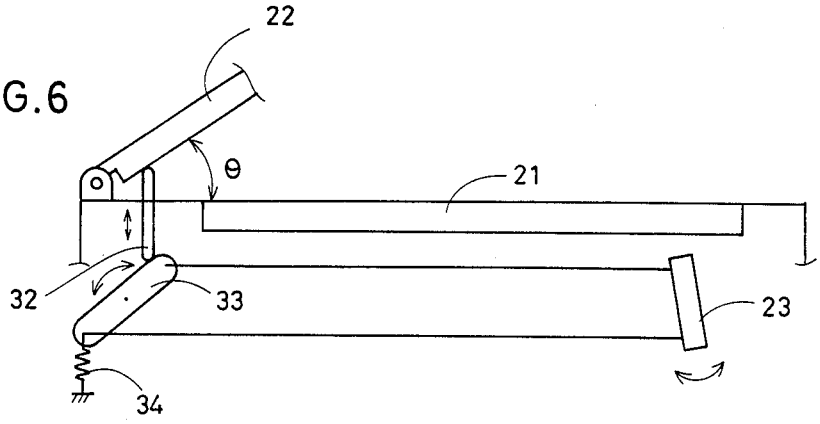
FIG. 6 shows a sectional view of a document cover of the present invention, showing a tilt mechanism of the sensor according to the present invention.

FIG. 6 shows a sectional view of a sensor tilt mechanism according to the present invention adapted for the device of FIG. 4.

The tilt mechanism of FIG. 6 comprises the document cover 22, an actuator 32, an arm 33, a spring 34, the sensor 23, and wires.

Figure 7:
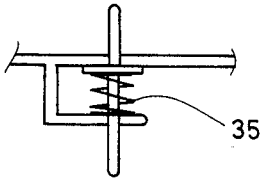
FIG. 7 shows a sectional view of an actuator assembled in the tilt mechanism of FIG. 6.

FIG. 7 shows a sectional view of the actuator 32 forced by a second spring 35.

The actuator 32 is moved upward and downward in conformance with the opening and the closing of the document cover 22 with the help of the spring 35 of the actuator 32. In response to the upward and the downward movement of the actuator 32, the arm 33 is rotated clockwise and counterclockwise with a fulcrum in the arm 33. The sensor 23 is wired with the arm 33, so that the sensor 23 is tilted in accordance with the rotation of the arm 33. The spring 34 biases the arm 33. Even when the cover 22 is opened with an angle more than theta, the actuator 32 is set not to respond the opening of the cover 22.

While only certain embodiments of the present invention have been described, it will be apparent to those skilled in the art that various changes and modifications may be made therein without departing from the spirit and scope the present invention as claimed.

What is claimed is:

1. A detecting device for detecting the opening and closing of a document cover means, said cover means being pivotable about an axis at one end thereof with respect to a document table means for an electrophotographic copying machine comprising:

sensor means for sensing the opening and the closing of the document cover means said sensor means including a light emitting element and a light receiving element;

a single light reflective means disposed on the underside of the document cover means for reflecting light from the light emitting element back toward the light receiving element; and detection means responsive to the output of the light receiving element for detecting whether the document cover means is disposed within a predetermined angular range about said axis and with respect to said document table means.

2. The device of claim 1, wherein the light emitting element is a light emitting diode and the light receiving element is a photodiode.

3. The device of claim 1, wherein the detection means comprises a signal generator means, a differencial circuit means, an amplifier means, an integration circuit means, and a comparator means.

4. The device of claim 1, wherein the sensor means is adapted to be tilted in synchronization with the pivotal angle of the document cover means.

5. The device of claim 1, wherein the reflective means is made of a material for receiving light in a given direction and for reflecting the light in the countering direction opposed to its incident direction.

6. The device of claim 4, wherein means for tilting the sensor means is provided which comprises an angle detection means for detecting the angle of the opening of the document cover means and a tilting means responsive to the detection of the angle detection means for tilting the sensor means.

7. The device of claim 6, wherein the angle detection means comprises an actuator moving in response to the opening of the document cover means, an arm rotating in accordance with the movement of the actuator, and wiring means responsive to the rotation of the arm for tilting the sensor means.

8. A detecting device for detecting the opening and the closing of a document cover means, said cover means being pivotable about an axis at one end thereof with respect to a document table means for an electrophotographic copying machine comprising:

sensor means for sensing the opening and the closing of the document cover means, said sensor means including a light emitting element and a light receiving element and being adapted for tilting in synchronization with the pivotal angle of the document cover means about said axis and with respect to said table means;

light reflective means disposed on the underside of the document cover means for reflecting light from the light emitting element back toward the light receiving element; and detection means responsive to the output of the light receiving element for detecting whether the document cover means covers or does not cover the document table means.

9. The device of claim 8, wherein the light emitting element is a light emitting diode and the light receiving element is a photodiode.

10. The device of claim 8, wherein the detection means comprises a signal generator means, a differential circuit means, an amplifier means, an integration circuit means, and a comparator means.

11. The device of claim 8, wherein the reflective means is made of a material for receiving light in a given direction and for reflecting the light in the countering direction opposed to its incident direction.

12. The device of claim 8, wherein means for tilting the sensor means is provided which comprises an angle detection means for detecting the angle of the opening of the document cover means and a tilting means responsive to the detection of the angle detection means for tilting the sensor means.

13. The device of claim 12, wherein the angle detection means comprises an actuator moving in response to the opening of the document cover means, an arm rotating in accordance with the movement of the actuator, and wiring means responsive to the rotation of the arm for tilting the sensor means.

* * * * *